United States Patent [19]

Beiswenger et al.

[11] 3,934,413

[45] Jan. 27, 1976

[54] AIR FLOW CONTROL UNIT FOR ENGINE SECONDARY AIR SUPPLY

[75] Inventors: David W. Beiswenger; Gordon R. Paddock, both of Rochester; Ernst L. Ranft, Webster, all of N.Y.

[73] Assignee: General Motors Corporation, Detroit, Mich.

[22] Filed: July 5, 1974

[21] Appl. No.: 485,817

[52] U.S. Cl. ..... 60/289; 60/307; 60/410; 137/118

[51] Int. Cl.[2] ..... F02B 75/10; G05D 11/00

[58] Field of Search ..... 60/289, 290, 307, 410, 60/409; 137/118; 91/1, 6

[56] References Cited

UNITED STATES PATENTS 3,812,673 5/1974 Muroki ..... 60/290

3,818,702 6/1974 Woo ..... 60/307

*Primary Examiner*—Douglas Hart

*Attorney, Agent, or Firm*—Robert M. Sigler

[57] ABSTRACT

In a system for delivering air from an air pump to an exhaust system and accessories for an internal combustion engine, an air flow control unit has a high pressure relief valve, an outlet open to the exhaust system, a vent open to the atmosphere and an outlet open to the accessories with a check valve therein. A valve member is movable in response to an engine signal between a first position closing the exhaust system outlet and a second position closing the vent; and a low pressure relief valve is included in the vent to maintain a minimum low pressure in the unit when the valve member is in its first position.

2 Claims, 2 Drawing Figures

AIR FLOW CONTROL UNIT FOR ENGINE SECONDARY AIR SUPPLY

SUMMARY OF THE INVENTION

This invention relates to an air flow control unit for use in a system for delivering air from an air pump to the exhaust system of a vehicle mounted internal combustion engine and to one or more accessories installed on the vehicle. The unit in its general design is similar to that shown in U.S. Pat. No. 3,835,646 to Ranft et al., assigned to the assignee of this application and hereby incorporated by reference therein.

The unit of our invention differs from that of the reference in that it is provided with an additional air outlet for the supply of air from the pump to one or more engine or vehicle accessories. Simply providing such an outlet, however, is not sufficient, since a constant minimum pressure is required for dependable accessory operation. In the reference unit, an air flow path to the exhaust system or the atmosphere is always open and, at low pump speeds, insufficient back pressure may be generated within the unit.

The reference unit contains a pressure relief valve, the purpose of which is to bleed off a portion of the large amount of air flowing to the exhaust system at high pump speeds. Therefore, the permanent closure of the vent to the atmosphere would enable accessory air pressure to build up whenever the valve member of the control unit closed the outlet to the exhaust system. However, since the pressure needed for accessory actuation is significantly smaller than that required to actuate the pressure relief valve, the pump would be forced to do an increased amount of work when the valve member of the control unit was positioned to vent air to the atmosphere. At low pump speeds, this is due to the fact that the pump must work against the high spring pressure of the pressure relief valve. At high pump speeds this is so because the opening of the pressure relief valve, having been designed to be large enough to handle only part of the pump air flow when the outlet to the exhaust system is open, is not large enough to handle the full air pump flow without creating a back pressure even greater than that necessary to open the pressure relief valve.

On the other hand, the opening pressure of the pressure relief valve cannot be lowered to the low pressure required by the accessories or the amount of air supplied to the exhaust system may not be sufficient to keep exhaust emissions within desired limits.

In order, therefore, to insure the supply of adequate air to the exhaust system and accessories and the maximization of engine efficiency, the air flow control unit of this invention includes a second pressure relief valve set to open at the required accessory air pressure and placed in the main atmosphere vent so that it is operable in parallel with the high pressure relief valve only when the valve member moves to its position closing the exhaust outlet.

Further details and advantages of this invention will be apparent from the drawings and following description of the preferred embodiment.

DESCRIPTION OF THE PREFERRED EMBODIMENT

Figure 1:
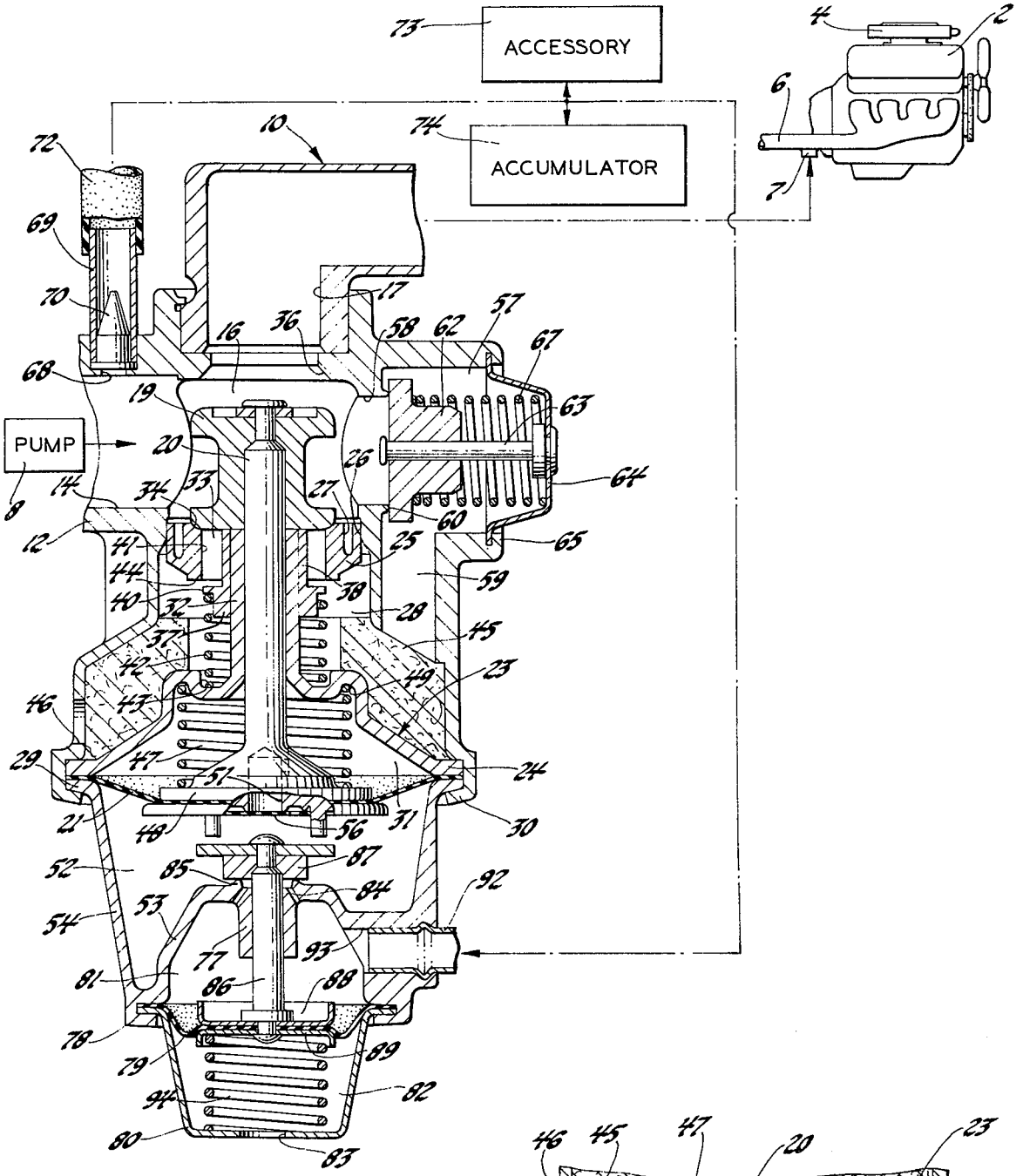
FIG. 1 shows a preferred embodiment of my invention.
Figure 2:
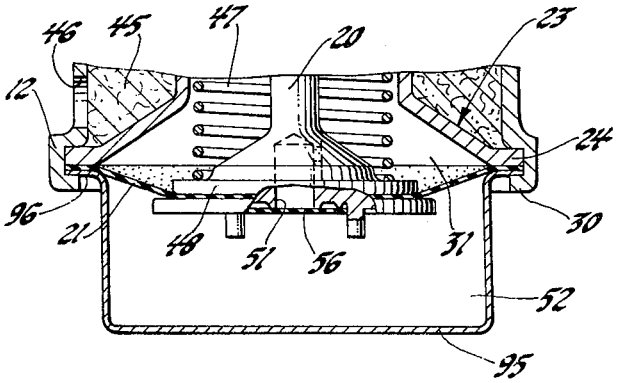
FIG. 2 shows a modification to the embodiment shown in FIG. 1.

The embodiments of FIGS. 1 and 2 differ only in that the unit of FIG. 1 is designed to be used with accessories which leak or expel the air supplied to them whereas the modification of FIG. 2 can be used with accessories which maintain air under pressure in a closed system.

Referring to FIG. 1, an internal combustion engine 2 with an intake system 4 and an exhaust system 6 drives an air pump 8 at a speed generally proportional to engine speed. The intake system 4 includes a source of intake manifold vacuum; and the exhaust system 6 is adapted for the admission of air thereto through an opening 7 for oxidation of unburned and partially burned hydrocarbons.

An air flow control unit 10 comprises a housing 12 with a lateral inlet 14 extending to a valve chamber 16. Air is received from the air pump 8 through inlet 14 and is discharged through a main outlet 17 to the exhaust system 6.

A valve member 19 located in valve chamber 16 is secured to the upper end of a valve stem 20. The lower end of valve stem 20 is secured to a diaphragm 21 which closes the lower end of housing 12.

An insert member 23 has a lower rim 24 secured between diaphragm 21 and housing 12. The upper rim 25 of insert 23 is pressed into a bore 26 of housing 12, a deep groove 27 in rim 25 facilitating the press fit.

The press fit of rim 25 and bore 26 prevents direct leakage of air from valve chamber 16 to an annular chamber 28 defined between insert 23 and housing 12. The lower rim 30 of housing 12 is spun over rim 24 of insert 23, the peripheral edge of diaphragm 21 and an upper rim 29 of a lower housing member 54 to seal a chamber 31, defined between diaphragm 21 and insert 23, from annular chamber 28. A guide portion 32 of insert 23 fits closely about stem 20 both to support and guide stem 20 and to prevent leakage of air between valve chamber 16 and chamber 31.

Insert 23 has a cylindrical recess 33 surrounding guide portion 32. The upper periphery of recess 33 defines a valve seat 34 which is engaged by the lower portion of valve member 19. When valve stem 20 is displaced upwardly, valve member 19 will be moved away from valve seat 34 and will engage a valve seat 36 surrounding main outlet 17. This will prevent air flow from inlet 14 to main outlet 17 and will divert that air flow into recess 33 where it meets a low pressure relief valve 37.

The low pressure relief valve 37 has a tubular portion 38 which fits around and slides on guide portion 32 and a flange portion 40 which extends radially outward from the tubular portion 38 to meet an inner surface 41 of the cylindrical recess 33. When valve member 19 moves away from valve seat 34, the low pressure relief valve 37 is free to slide reciprocally in cylindrical recess 33. Downward motion of low pressure relief valve 37 is opposed by a coil spring 42 surrounding guide portion 32 and compressed between flange portion 40 and a spring seat 43 formed in insert member 23.

A pair of diametrically opposed apertures 44 in insert member 23 communicate cylindrical recess 33 with annular chamber 28. When valve member 19 is raised away from valve seat 34, increasing air pressure in valve chamber 16 forces low pressure relief valve 37 downward against spring 42 until flange portion 40 passes the tops of apertures 44, at which point air begins to flow from valve chamber 16 through cylindrical recess 33, apertures 44, annular chamber 18 and a plurality of apertures 46 through housing 12 to the atmosphere. An annular pad of silencing material 45 partially fills chamber 28 to reduce the noise carried from the pump 8.

The pressure in valve chamber 16 at which flange portion 40 passes the upper end of apertures 44 to allow air flow therethrough will be termed the low relief pressure and is determined by the characteristics of spring 42. The low relief pressure for most applications will be in the range of 3 psig to 5 psig. When valve member 19 seats against valve seat 34 to close cylindrical recess 33 from valve chamber 16, low pressure relief valve 37 is not operative.

As shown in the reference patent, annular chamber 31 communicates with a source of intake manifold vacuum in the intake system 4. During engine deceleration, manifold vacuum rises abruptly, and the vacuum in chamber 31 increases correspondingly to raise diaphragm 21 and the valve stem 20 against the bias of a spring 47 which is compressible between a flange 48 at the bottom of valve stem 20 and a spring seat 49 formed in insert 23. As explained above, this seats valve member 19 against valve seat 36 to interrupt air flow from pump 8 to exhaust system 6 and thus prevent backfiring in the exhaust system.

A passage 51 extends through the lower portion of valve stem 20 to connect vacuum chamber 31 with a chamber 52 defined between diaphragm 21 and a stem support flange 53 extending radially inward from lower housing 54. Check valve means 56, described in greater detail in the reference patent, are included in passage 51 to regulate flow between chambers 31 and 52. Check valve means 56 allow unrestricted air flow from chamber 31 to chamber 52 but restricted flow at a controlled rate from chamber 52 to chamber 31. Thus, after a sudden decrease in pressure within vacuum chamber 31 with a resulting upward movement of valve stem 20, valve stem 20 is allowed to return to the position shown after a period of time determined by the rate of air flow from chamber 52 to chamber 31 through check valve means 56.

Housing 12 has a pressure relief passage 57 extending from a lateral opening 58 in the side of valve chamber 16 diametrically opposite inlet 14. Pressure relief passage 57 includes an axially extending portion 59 which opens into the top of annular chamber 28.

A valve seat 60 is formed about opening 58 and is engaged by a valve member 62. Valve member 62 slides on a shaft 63 which is mounted on a cover member 64 secured by a spun over portion 65 of housing 12.

A spring 67 biases valve member 62 into engagement with seat 60 against air pressure within valve chamber 16. The valve member 62 and associated parts form a high pressure relief valve which opens when air pressure within valve chamber 16 reaches a level typically 8 to 10 psig, which is the minimum air pressure necessary to insure adequate air flow into exhaust system 6 at high engine speeds. When high pressure relief valve 62 is open, a portion of the air flow through inlet 14 is diverted through opening 58, passage 57, chamber 28 with its silencing material 45 and apertures 46 to the atmosphere.

An accessory outlet 68 opens from inlet 14 to an outlet tube 69 which contains a check valve 70 that allows unrestricted air flow outward through accessory outlet 68 but no air flow backward from tube 69 to inlet 14. A conduit 72 connects outlet tube 69 with one or more accessories 73 and, if required, an accumulator tank 74. Since the accessories 73 dissipate the air supplied to them over time, additional air must be supplied through accessory outlet 68 to maintain the required accessory air pressure. This occurs whenever valve 19 closes outlet 17; but since engine operating conditions exist wherein valve 19 may not be actuated sufficiently often, accessory air pressure sensing and auxiliary valve actuating means are included.

Lower housing member 54 includes stem support flange 53 which extends radially inward and ends in a guide portion 77. A portion 78 at the bottom of lower housing member 54 is spun over the peripheral edge of a diaphragm 79 and a lower cup 80. A chamber 82, defined between diaphragm 79 and lower cup 80, is open to the atmosphere through an aperture 83 in lower cup 80. A pressure sensing chamber 81, defined between diaphragm 79 and stem support flange 53, opens through one or more apertures 84 through stem support flange 53 to chamber 52. A valve seat 85 comprises a raised circular ridge surrounding apertures 84 on the surface of stem support flange 53 within chamber 52. A valve stem 86, receiprocable in guide portion 77, has a valve member 87 attached to one end within chamber 52 and a pair of shallow cups 88 and 89 attached to its other end with diaphragm 79 sandwiched therebetween, cup 88 within chamber 81 and cup 89 within chamber 82.

Conduit 72 connects outlet tube 69 to a tube 92 projecting through an opening 93 in lower housing member 54 which opens to pressure sensing chamber 81. Accessory air pressure, supplied to chamber 81 through conduit 72 and tube 92, exerts a pressure above atmospheric on diaphragm 79 which is balanced by the force of a spring 94 in compression between lower cup 80 and cup 89. The pressure is also communicated through apertures 84 to valve member 87; however, since the surface area of diaphragm 79 is much larger than that of valve member 87 inside valve seat 85, the greater this pressure becomes, the harder the valve member 87 is pulled against valve seat 85.

When the accessory air pressure falls to the low relief pressure, spring 94 pushes valve stem 86 upward so that valve member 87 moves away from valve seat 85, thus allowing air at atmospheric or greater pressure into chamber 52. The increased air pressure in chamber 52 causes diaphragm 21 to raise valve stem 20 and valve member 19 to close main outlet 17, with a resulting increase in accessory air pressure as previously described. When accessory air pressure builds up sufficiently in accessories 73 and accumulator tank 74, valve member 87 is once again pulled against valve seat 85 and valve member 19 returns to its normal mode of operation after a slight delay while the extra air in chamber 52 bleeds through the check valve means 56.

If the accessories 73 lose little or no air, then neither accumulator tank 74 nor accessory air pressure sensing and auxiliary valve actuation means are necessary. The high manifold vacuum created during engine starting actuates valve 19 and charges accessory 73 with accessory air pressure; while subsequent similar actuation of valve 19 prevents loss of accessory air pressure due to slow leaks.

In this case, referring to FIG. 2, lower housing member 54 and all other parts associated with it have been replaced by a lower cup 95, the outer rim 96 of which is held sealingly in the folded over lower rim 30 of housing member 12. In such an embodiment, there is no accumulator tank and the conduit 72 connects outlet tube 69 only with the accessories 73.

The description just completed is only of preferred embodiments of our invention. Equivalent embodiments will occur to those skilled in the art; and therefore our invention should be limited only by the claims which follow.

We claim:

1. Means for supplying pressurized air at an accessory air pressure for an accessory mounted on a vehicle equipped with a combustion engine having an exhaust system, the pressurized air supply means comprising, in combination:

an air pump driven by the engine, the air pump having an outlet;

an air control unit including a chamber open to the air pump outlet, the chamber having an exhaust supply outlet, an accessory supply outlet, a high pressure relief outlet and a low pressure relief outlet, the exhaust supply and low pressure relief outlets being diametrically opposed across the chamber;

check valve means in the accessory supply outlet to prevent air flow back into the chamber;

a high pressure relief valve in the high pressure relief outlet, the high pressure relief valve being openable by air at a high pressure greater than the accessory air pressure to vent the chamber to the atmosphere;

conduit means connecting the exhaust supply outlet with the engine exhaust system;

valve means in the chamber reciprocable between a first position closing the exhaust supply outlet and a second position closing the low pressure relief outlet;

valve actuation means in the air control unit outside the chamber, the valve actuation means including a stem linked with the valve means, the valve actuation means being responsive to an engine signal to move the valve means between its first and second positions;

an annular insert member in the air control unit, the insert member having an inner cylindrical surface defining a low pressure relief conduit having one end open to the low pressure relief outlet and a central guide portion within the low pressure relief conduit and coaxial therewith, the central guide portion surrounding the stem, the insert member having an aperture through the inner cylindrical wall opening the low pressure relief conduit to the atmosphere;

a low pressure relief valve member reciprocable on the guide portion within the low pressure relief conduit, the low pressure relief valve member sealingly engaging the guide portion and the inner cylindrical wall;

spring means biasing the low pressure relief valve member toward the low pressure relief outlet, the spring means thereby balancing the force of air on the low pressure relief valve member with the vlave means in its first position, the spring means having such characteristics that the low pressure relief valve member closes the low pressure relief outlet from the aperture when the air pressure in the chamber is less than the accessory air pressure but moves past the aperture to open it to the low pressure relief outlet when air pressure in the chamber exceeds the accessory air pressure.

2. Means for supplying pressurized air for an accessory mounted on a vehicle equipped with a combustion engine having an exhaust system, the pressurized air supply means comprising, in combination:

an air pump driven by the engine, the air pump having an outlet;

a first conduit connecting the air pump outlet with the engine exhaust system;

a second conduit venting the air pump outlet to the atmosphere;

valve means in the air pump outlet movable between a first position closing the first conduit only and a second position closing the second conduit only;

means to move the valve means between its first and second positions in response to an engine signal;

an accessory air outlet connecting the pump outlet to the accessory, the accessory air outlet including means to prevent air flow back into the pump outlet;

a high pressure relief valve openable by air at a high pressure to vent the air pump outlet to the atmosphere; and a low pressure relief valve in the second conduit and openable by air at a low pressure between the high and atmospheric pressures only when the valve means is in its first position, whereby pump back pressure and hence energy used by the pump is reduced to only that necessary to maintain the low air pressure for the accessory when air is not supplied to the exhaust system, the low pressure relief valve being isolated from the pump outlet by the valve means in its second position, whereby the air supplied to the engine exhaust system is maintained at the high pressure to ensure sufficient air to maximize the oxidation of oxidizable exhaust constituents.

* * * * *